United States Patent [19]

Estang

[11] Patent Number: 4,933,681

[45] Date of Patent: Jun. 12, 1990

[54] RADAR ANTENNA OF SMALL OVERALL DIMENSIONS

[75] Inventor: Bernard Estang, Chevreuse, France

[73] Assignee: Thomson-CSF, Paris, France

[21] Appl. No.: 7,761

[22] Filed: Jan. 28, 1987

[30] Foreign Application Priority Data

Jan. 28, 1986 [FR] France ..... 86 01173

[51] Int. Cl.[5] ..... H01Q 3/12

[52] U.S. Cl. ..... 343/765; 343/705; 343/766

[58] Field of Search ..... 343/705, 708, 761, 762, 343/765, 766, 872, 757

[56] References Cited

U.S. PATENT DOCUMENTS

| | | | |
|---|---|---|---|
| 3,307,183 | 2/1967 | Adam | 343/761 |
| 3,860,930 | 1/1975 | Peterson | 343/705 |
| 3,898,668 | 8/1975 | Evans et al. | 343/761 |
| 4,173,762 | 11/1979 | Thompson et al. | 343/761 |
| 4,312,002 | 1/1982 | Stewart | 343/761 |
| 4,512,448 | 0/1985 | Estang | 188/378 |
| 4,593,288 | 1/1986 | Fitzpatrick | 343/705 |
| 4,772,892 | 9/1988 | Payelian et al. | 343/765 |

FOREIGN PATENT DOCUMENTS

| | | | |
|---|---|---|---|
| 0866349 | 4/1961 | United Kingdom | 343/761 |
| 2144584 | 3/1985 | United Kingdom | 343/765 |

*Primary Examiner*—Rolf Hille
*Assistant Examiner*—Doris J. Johnson
*Attorney, Agent, or Firm*—Cushman, Darby & Cushman

[57] ABSTRACT

A radar antenna of small overall dimensions is provided, placed in a belly radome, including a reflector of paraboloid shape of revolution about the longitudinal axis and integral with a case. This assembly is mounted for pivoting about the transverse axis and about the vertical axis inside the radome.

Rotation about the longitudinal axis called roll axis is provided by rotating the transmission source by rotation means placed inside the case and the duct. With the reflector fixed in the roll direction, the area thereof may extend over the whole of the inner section of the radome, rotation of the radar beam along the roll axis being obtained through rotation of the source with respect to the reflector.

8 Claims, 2 Drawing Sheets

FIG_1 (PRIOR ART)
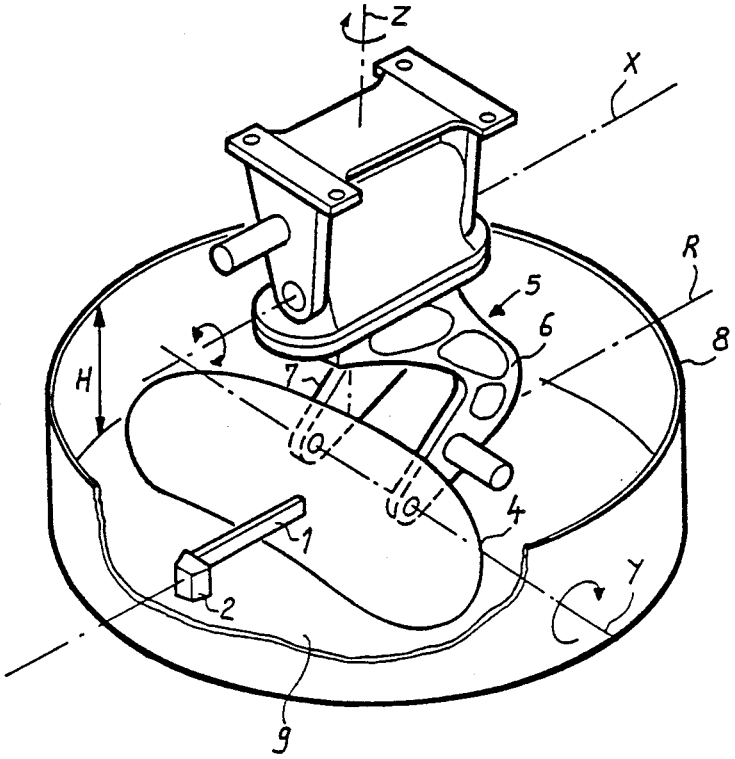
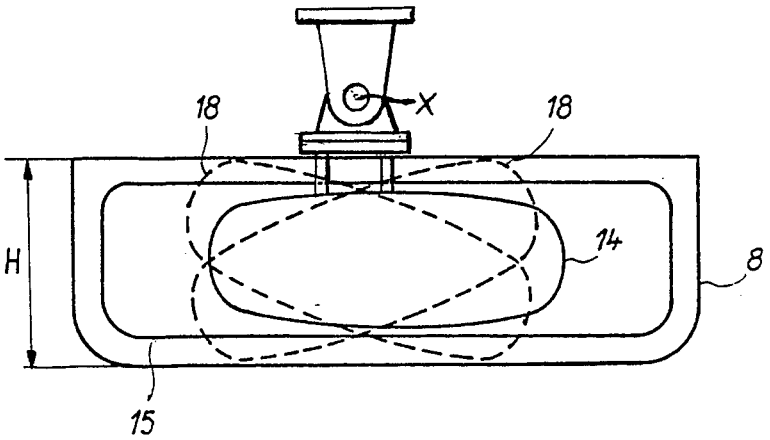
FIG_2

RADAR ANTENNA OF SMALL OVERALL DIMENSIONS

BACKGROUND OF THE INVENTION

1. Field of the Invention

The invention relates to airborne and embarked watch and air-surface fire control radar antennae placed in a radome.

2. Description of the Prior Art

Sea surveillance and air-sea missile fire control radars have their antennae installed in a radome, situated under the fuselage of the aircraft when it is airborne. This arrangement provides a 360° range of surveillance. For reasons of cost and simplicity of the aircraft, and in particular of aeroplanes, it is desirable for the radome to be not retractable but installed in a fixed position under the fuselage.

Thus, the dimensions of the radome are defined by the amount of extra admissible aerodynamic drag caused by the radome and by the space available between the lower part of the fuselage and the ground, when landing. Once these dimensions have been fixed, the radome and consequently the radars must have the largest antenna possible in the available volume of the radome.

A surveillance radar performs a predetermined movement with respect to its sight line, which is the straight line joining the center of the antenna to the target. Two articulation axes are then sufficient in the mechanical system for orientating the antenna.

On the other hand, a fire control radar permanently measures, in a horizontal plane, the angular error between the target and the missile. The measurement must be independent of the movements of the aircraft and consequently the antenna must be stabilized along three axes. A third mechanical axis is then required so as to be able to maintain the line of sight oriented on the missile whatever the movements of the aircraft. In fact, so that, after firing, the aircraft may execute an evasive turn while continuing to guide the missile, the antenna must be stabilized during rolling so as to keep the plane of measurement horizontal. To sum up, a vertical axis allows a movement of rotation for a 360° sweep and for countering the yaw movements of the aircraft. Rotation about the transverse horizontal axis compensates for the pitching movements. Similarly, a movement of rotation about a longitudinal horizontal axis compensates for a rolling movement of the aircraft.

The radar antennae already existing include a parabolic reflector and a monopulse source of energy, better known under the name "rear feed". In such a system, the source is the main active element, the parabolic element only acting as reflector, both for transmission and for reception. The source is fixed with respect to the reflector. On the other hand, this latter undergoes the rotational movement about the transverse axis and the rotational movement about the longitudinal axis. In general, the shape of the reflector is related to a strip cut out from a paraboloid of revolution and placed vertically in the radome. The last movement of rotation about the longitudinal axis means that a considerable space must be provided so that the reflector can perform this third movement. With the overall dimensions of the radome determined, the size of the reflector is considerably reduced, and consequently the range of detection of the radar is also reduced.

In other words, for a land or sea patrol aircraft with a belly radome of given size, the need in fire control mode to stabilize the antenna in the direction of the target in the space of the radome considerably reduces the size of the antenna because of the rotational movements about the longitudinal axis.

The aim of the invention is to overcome this drawback by providing an antenna with sufficient cross section and allowing fire control to be performed while still keeping small overall dimensions.

SUMMARY OF THE INVENTION

An object of the invention is to provide a radar antenna, more particularly intended to be installed in a radome on board an aircraft, and used for surveillance, tracking or fire control, including a transmitting source, a parabolic reflector of revolution about an axis passing through said source to form a beam of rays, means for orientating said beam along a first longitudinal axis called roll axis, and means for orientating along a second transverse axis called pitch axis, the whole being set in rotation about a third vertical axis called yaw axis. The antenna is characterized in that the means for orientating along the first longitudinal axis are formed by means for setting said source in rotation about the longitudinal axis. The reflector remains fixed during rolling with respect to the aircraft.

BRIEF DESCRIPTION OF THE DRAWINGS

The invention and its characteristics will be better understood from reading the following description with reference to the accompanying figures in which:

FIG. 1 is a view showing an antenna of the prior art;

FIG. 2 is a diagram of the problem solved by the invention;

DESCRIPTION OF THE PREFERRED EMBODIMENTS

Figure 3:
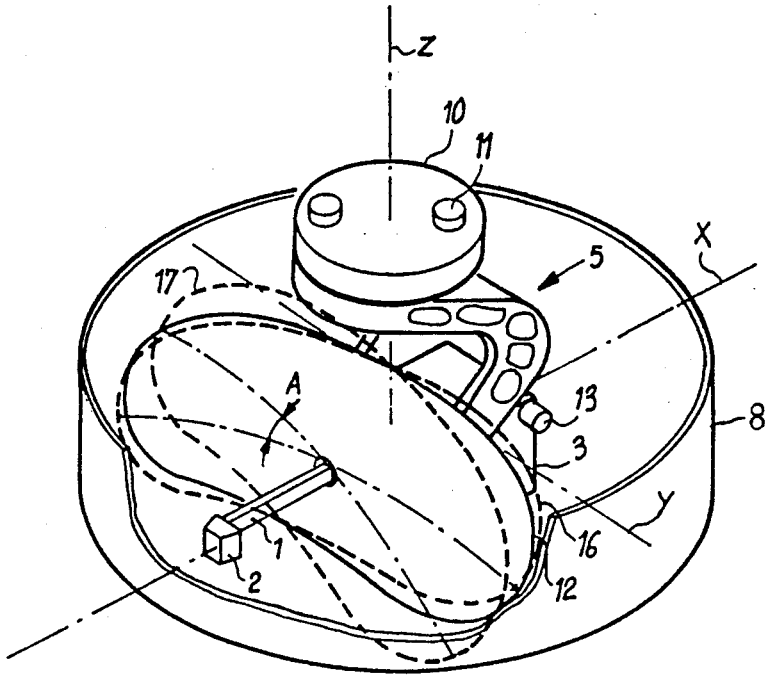
FIG. 3 is a view of an antenna of the invention.

FIG. 1 shows in perspective an antenna such as it exists in the prior art. The energy required for the transmitting source is brought through a duct 1, for example a wave-guide, as far as a diffusion element 2 called in the rest of the description: the source. This assembly is firmly fixed to a reflector 4. This reflector is a parabolic surface of revolution about a first axis R passing through the source which is placed at the focus of the parabola. This axis represents the orientation of the aircraft and is parallel to the longitudinal axis of the aircraft. The reflector is placed behind the source. The reflector and the source may pivot about a second axis Y, also called transverse axis. This rotation takes place with respect to a frame 5 which may be formed by two arms 6 and 7 and which thus supports the source-reflector assembly. This assembly is mounted for pivoting about a third axis X perpendicular to the transverse axis Y parallel to the longitudinal axis of the aircraft. This new assembly is itself mounted for pivoting about a fourth axis Z which is vertical. This latter rotation takes place with respect to the aircraft. The assembly formed by the source 2 and reflector 4 may then, as can be seen in FIG. 1, effect a complete rotation about the vertical axis Z so as to provide a 360° sweep required for the surveillance function of the radar. It also allows yawing movements to be effected. Rotation about the transverse axis Y is limited mechanically by the aircraft and, on the other hand, by the lower wall 9 of the radome 8 inside which the antenna is installed. This rotation compensates for the pitching movements. Finally, rotation about the longitudinal axis X compensates for the rolling movements of the aircraft, particularly when this latter makes turns such as evasive curves necessary after firing.

The rotation of reflector 4 about the longitudinal axis X can only take place to the extent that, the form of the reflector, once set in rotation with frame 5, describes a space contained inside the radome 8. The height H defining the permitted height of the radome is set by the lower part of the fuselage and the ground during landing. The shape of the reflector is therefore limited by this rotation about the longitudinal axis X.

In FIG. 2 there have been shown simultaneously and in a front view two different surfaces 14 and 15. The first one 14 symbolizes the surface of reflector 4 of the prior art. The shape drawn is that of an ellipse. With broken lines there have been shown two surfaces 18 identical to surface 14 and symbolizing the space required by the reflector 4 when it rotates about the longitudinal axis X. With the height H prescribed, it will be readily understood that the shape of the reflector is also prescribed. The second surface 15 symbolizes the surface of reflector 12 of the invention. This latter practically fills the cross section of the radome 8. The antenna of the invention is designed with a view to using high performance equipment. The surface of the reflector must be larger. Considering the prescribed overall dimensions of the radome 8, in accordance with the invention, it is proposed to use a reflector whose surface, larger when seen from the front, fills to a large extent the section of the radome, as shown in FIG. 2 where this surface is referenced 12.

With reference to FIG. 3, this reflector 12 also has a parabolic form of revolution about the longitudinal axis X, merging with the axis R of FIG. 1, but extends over substantially the whole cross section of the radome. There can also be seen in this FIG. 3 the trace 16 on reflector 12 of the beam emitted by source 2. Since the reflector has a transversely elongate shape, the beam emitted by the antenna has a very elongate shape in the vertical direction, and could be compared with a knife blade placed vertically.

Figure 4:
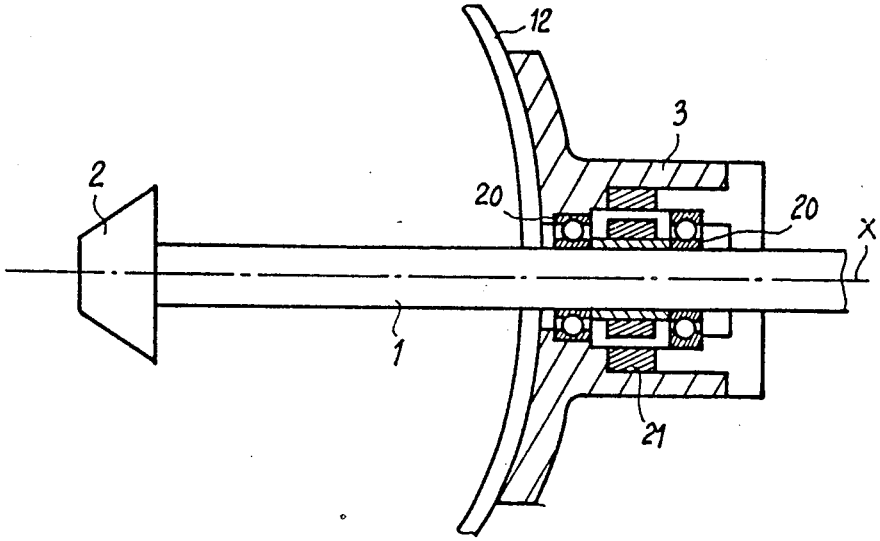
FIG. 4 is a sectional view of a part of the antenna of the invention.

According to the invention, for obtaining the rotational movement of the beam about the longitudinal axis X, the transmitting source 2 is caused to rotate, i.e. the transmitted beam symbolized by trace 16. This beam may then remain permanently vertical, even if the aircraft makes a turn and, more particularly, an evasive curve after firing. This rotation about the longitudinal axis X is obtained by a device shown schematically in FIG. 4. In FIG. 4 there is only shown a case 3 placed behind reflector 12 and mounted for pivoting about the transverse axis Y with respect to the frame 5. The assembly is mounted for pivoting about the vertical axis Z, with respect to the aircraft represented by the piece 10. Motor driven reducing systems 11 and 13 ensure rotation about the vertical X and transverse Y axes.

In FIG. 4, inside case 3, has been mounted the guide 1 integral with source 2 rotating on ball bearings 20. This rotation is obtained by means of a servo motor 21. With the reflector 12 remaining fixed and being a surface of revolution, when the source rotates about the axis X, causing the beam to pivot on itself with respect to the reflector, a rotation is obtained of the transmission diagram of the antenna similar to the rotation obtained in the prior art, when the source-reflector assembly rotated.

With the invention, for a radome of given size, the largest possible antenna may be obtained by replacing the roll stabilization of a large-sized element, namely the reflector, by roll stabilization of a much smaller element, namely the source. The size of the servo-motors and of the stabilization circuits is reduced, the electric power consumption is smaller and the weight is also smaller. The increase in size of the reflector allows the detection range of the radar to be increased directly proportionally. Suppression of the rolling movement of the reflector reduces the useful height of the radome under the aircraft, and so increases the ground clearance at the time of landing. For a given detection range, the antenna is therefore of a smaller size.

In the fire control mode, a smaller antenna area may suffice for the energy requirements of the radar. Rotation of the source may be brought to roll values which could not be obtained by rotation of the source-reflector assembly of the prior art. This allows the aircraft to make a much tighter turn.

Referring to FIG. 3, illumination of source 2 in the normal position forms on reflector 12 an ellipse 16 having as large an axis as the width of the reflector, and as small an axis as the height of the reflector. When the source rotates about the longitudinal axis X, through an angle A for roll stabilization reasons, the ellipse rotates about the same axis X while continuing to illuminate the reflector along a trace 17. Since the reflector is a paraboloid of revolution, the shape and characteristics of the beam, namely the antenna diagram, are not deformed and pivot about the same axis X, as if the reflector-source assembly pivoted.

Beyond a certain roll value, the illumination occurs partially outside the reflector. The antenna gain is then reduced. Since the fire control, which requires roll rotation, takes place at a close distance, the more reduced energy requirements thus allow a smaller antenna area. On the other hand, in the surveillance mode, searching for a distant target requires the largest area possible. This is then possible since, in this mode, roll rotation of the source is not required and the reflector is illuminated as a whole.

The advantages obtained with the antenna of the invention are considerable when it is used on board an aircraft. Its use on boats may further be envisaged.

What is claimed is:

1. A radar antenna used for surveillance, tracking or fire control purposes, and positioned on an aircraft having a longitudinal axis, comprising:

a transmitting energy source for transmitting a beam which always has its lobe along a first axis;

a parabolic reflector defining a portion of a surface of revolution for said source and rotatable around said first longitudinally extending, central axis;

means for rotating said source around the first axis, while maintaining said lobe along said first axis, to compensate for rolling movements of the radar antenna;

means for orientating said reflector and said source along a second transverse pitch axis to compensate for pitching movements of the radar antenna; and means for rotating said reflector and energy source about a third vertical yaw axis which is perpendicular to said first axis and to said second axis, said rotating means rotatable about a 360 degree sweep.

2. The radar antenna as claimed in claim 1, wherein said reflector is fixed about said first axis and with respect to said aircraft.

3. The radar antenna as claimed in claim 1, comprising use thereof on board an aircraft.

4. The radar antenna as claimed in claim 2, comprising use thereof in a radome.

5. The antenna as claimed in claim 4, wherein the area of said reflector is inside the section of the radome and substantially fills the inside of said radome.

6. The antenna as claimed in claim 1, further comprising a waveguide passing through the reflector carrying the energy for said source; and wherein the rotating means comprises:

a ball bearing assembly; and a servo-motor rotating an assembly of the waveguide and the source to rotate on said ball bearing assembly placed inside a case fixed with respect to the reflector and placed therebehind; the assembly of the waveguide and the source being mounted for pivoting about the second transverse axis by the means for orientating along the second traverse axis.

7. The antenna as in claim 2 wherein said radar antenna is a monopulse antenna.

8. A monopulse radar antenna assembly for use in an aircraft which has a longitudinal axis, to compensate for rolling movements, comprising:

a radome coupled to said aircraft;

a reflector, of a size to substantially fill said radome;

a source, positioned to be rotatable with respect to said reflector around a first axis and producing a transmission along said first axis; and means for rotating said source around said first axis, while still producing said transmission along said first axis, to compensate for rolling movements of the aircraft.

* * * * *